US011585580B2

(12) United States Patent
Irons

(10) Patent No.: US 11,585,580 B2
(45) Date of Patent: Feb. 21, 2023

(54) HIGH-PRESSURE TO LOW-PRESSURE LINE SET JOINING TOOL FOR AIR CONDITIONING AND REFRIGERATION SYSTEMS AND METHODS

(71) Applicant: Ryan Irons, Modesto, CA (US)

(72) Inventor: Ryan Irons, Modesto, CA (US)

( * ) Notice: Subject to any disclaimer, the term of this patent is extended or adjusted under 35 U.S.C. 154(b) by 192 days.

(21) Appl. No.: 17/080,835

(22) Filed: Oct. 26, 2020

(65) Prior Publication Data

US 2022/0128284 A1 Apr. 28, 2022

(51) Int. Cl.

| | |
|---|---|
| ***F25B 45/00*** | (2006.01) |
| ***F25B 49/02*** | (2006.01) |
| ***B08B 9/032*** | (2006.01) |
| *F25B 41/20* | (2021.01) |
| *B05B 13/06* | (2006.01) |

(52) U.S. Cl.

CPC ..... *F25B 49/02* (2013.01); *B08B 9/0321* (2013.01); *F25B 45/00* (2013.01); *B05B 13/0627* (2013.01); *F25B 41/20* (2021.01); *F25B 2345/00* (2013.01); *F25B 2345/002* (2013.01); *F25B 2400/075* (2013.01); *F25B 2600/2513* (2013.01)

(58) Field of Classification Search

None

See application file for complete search history.

(56) References Cited

U.S. PATENT DOCUMENTS

| | | | | |
|---|---|---|---|---|
| 4,266,813 | A * | 5/1981 | Oliver | F16L 25/14 285/423 |
| 5,540,359 | A | 7/1996 | Gobbel | |
| 8,944,112 | B2 * | 2/2015 | Bieszczad | F16L 11/085 138/137 |
| 8,985,635 | B2 * | 3/2015 | Hurley | F24F 13/222 285/179 |
| 2004/0195371 | A1 | 10/2004 | Doud | |
| 2005/0081914 | A1 * | 4/2005 | Kalley | F25B 45/00 137/1 |
| 2018/0361438 | A1 * | 12/2018 | Smeltzly | B08B 9/027 |

* cited by examiner

*Primary Examiner* — Jerry-Daryl Fletcher
*Assistant Examiner* — Daniel C Comings
(74) *Attorney, Agent, or Firm* — Sierra IP Law, PC; William K. Nelson

(57) ABSTRACT

The present invention provides an improved method for flushing a solvent through a line set of a condenser, compressor, and routing of heat ventilation and air-conditioning, and a high-pressure to low-pressure coupling device. The novel device is operable for joining the high-pressure and low-pressure lines and eliminates the need for having multiple technicians present for conducting a line set flush.

20 Claims, 3 Drawing Sheets

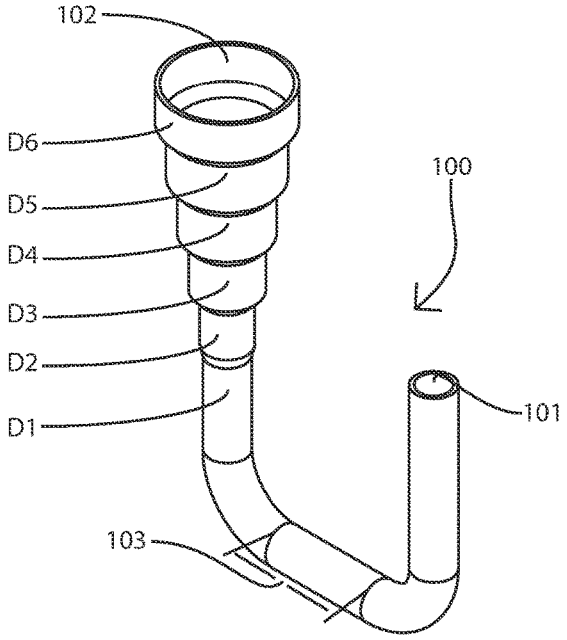
FIG. 1
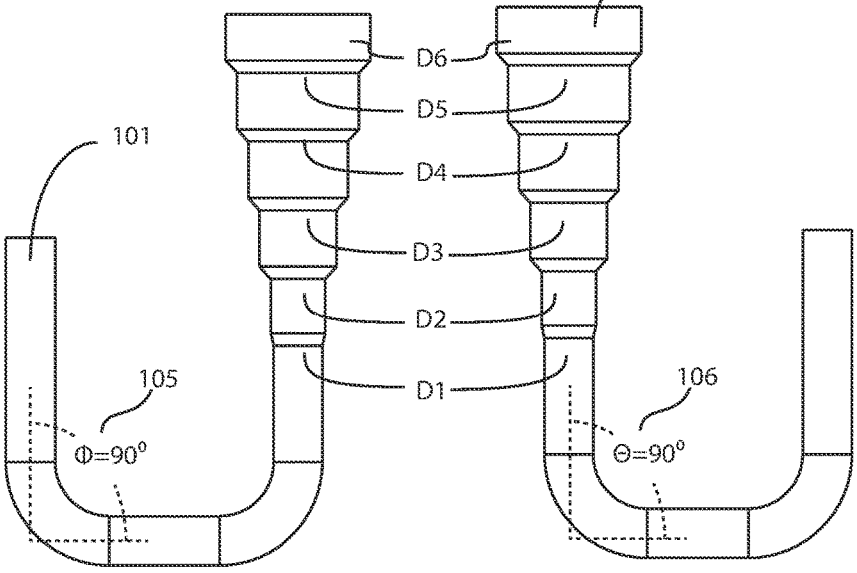
FIG. 2A
FIG. 2B
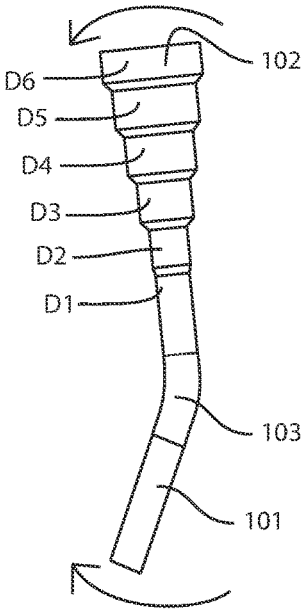
FIG. 2C

HIGH-PRESSURE TO LOW-PRESSURE LINE SET JOINING TOOL FOR AIR CONDITIONING AND REFRIGERATION SYSTEMS AND METHODS

FIELD OF THE INVENTION

The present invention generally relates to tooling and routing of a flushing solvent in a line set of a condenser, compressor, and routing of heat ventilation and air-conditioning, and methods of using the same. More particularly, the present invention provides a novel device operable for joining the low-pressure and high-pressure lines of a compressor when flushing and eliminate the need for multiple technicians on a work site.

BACKGROUND OF THE INVENTION

Heating ventilation and air conditioning (HVAC), air-conditioning (A/C) and refrigeration systems are typically configured with various sub-systems. For example, an A/C system requires at least one compressor, a condenser, an evaporator, and an expansion valve. A compressor is operable to move a working fluid (e.g., mineral oil, refrigerant, etc.) through the condenser, expansion valve, and evaporator. A condenser ejects unwanted heat to a warm environment (e.g., typically outside), and an evaporator removes heat from an environment (e.g., cold refrigerated space). There may be additional valves and filters on an HVAC system such as: moisture-liquid indicators, diaphragm packless valves, replaceable core suction line filter, seal cap packed valve, suction accumulator, compressor service valve, discharge muffler, oil regulator, oil separator, check valve, relief valves, charging and purging valves, and receiver valves.

Such systems typically require periodic flushing to remove soot, contaminants, and sludge from the system. Flushing is also required after the interior of the system is exposed to ambient air, during replacement of the refrigerant compressor after burnout, for system retrofits, and for flushing line sets for coolant conversions (e.g., from freon to puron coolant conversion). Flushing procedures typically utilize nitrogen gas to flush out lines carrying refrigerant or coolant (e.g., freon, puron, ethylene glycol, etc.). A converging nozzle is typically sealed against an open line, and the nitrogen gas is forced through the line. A solvent is also typically used to assist in the removal of debris and residues from the line. The solvent is injected at the same entry and exit points. For the solvent to work efficiently, the exit point is crimped to increase the pressure in the line and subsequently to increase the mass flow rate of the solvent as it travels through the line. However, the injection of solvent into the system typically requires at least two technicians to monitor the flushing and purging process of the solvent through the system. The conventional approach for flushing and purging such systems is inefficient.

SUMMARY OF THE INVENTION

The present invention provides a line set purging device for joining the low pressure and high-pressure lines of a condenser and compressor of an HVAC system, and methods of using the same. The present invention allows a single technician to connect the coupling device to a line set at a charging location where the nitrogen gas, solvent, and/or other flushing material is introduced into the system (the "charging location") and collect the discharge material (coolant and debris) at a remote position along the line set when the technician is flushing the system. Conventional methods require two technicians to perform a flushing operation, with one individual at the charging location and the other at the collection point for the flushed coolant (e.g., at an access point cut into lines or at the condenser of the system). The present system offers a tool and method that significantly improves the efficiency of the HVAC, A/C, and cooling system flushing process.

An HVAC or other cooling system may have a line set that runs between a condenser unit and an evaporator unit to transmit coolant (e.g., freon, puron, ethylene glycol, etc.) between the two units. The line set may include a high-pressure line drives the coolant into the evaporator and a low-pressure line brings the coolant back to the condenser. The coolant in the evaporator collects thermal energy from the interior of the building, and the heat is then transmitted by the coolant to the condenser outside of the building, thereby cooling the interior of the building. The line set may have varying lengths, depending on the relative locations of the condenser and evaporator in the building, since the evaporator is typically located in the interior of a building and the condenser is typically located on the exterior of the building. In some systems, the evaporator may be hundreds of feet away (e.g., 500 feet) from the condenser and may require the line set that is hundreds of feet in length. In such systems, it may be necessary to cut the line set in increments (e.g., increments in a range of about 20 feet to about 80 feet, such as about 50 feet, or any value therein), and each set of line increments may be purged individually to clean the lines of unwanted minerals and debris.

The purging device of the present invention may be used to connect the high-pressure and low-pressure lines of an HVAC, A/C, or other cooling system, which enables a single technician to purge the line set without assistance. The purging device may include a fixed diameter end that is operable to attached to the high-pressure line of the line set (the "high-pressure end"), which has a standard, consistent diameter. The purging device may have a second variable diameter end for attachment to the low-pressure line (the "low-pressure end"), which may have a varying size depending on the particular system. Several different pipe diameters are used for low-pressure lines in HVAC, A/C, and other cooling systems, and thus the purging tool must be adaptable to different pipe sizes. The purging tool of the present invention includes a low-pressure end that has a plurality of different diameters for accommodating and connecting to low-pressure lines of various diameters.

The purging device may have a transition section that joins the high-pressure end and the low-pressure end. The transition section may be a flexible section that allows the high-pressure end and the low-pressure ends to be manipulated to attach to access points in line sets of varying arrangements (e.g., with varying distance from each other, and/or with obstructions therebetween), such that two ends of the purging device can be placed in parallel to each other and connected to parallel line sets. In some embodiments, the transition section may have a 180° transition that allows each end of the purging device to be connected to the access points in the parallel high-pressure and low-pressure lines during a purging process. In some embodiments, the transition section may have an elliptical turn that allows the high-pressure end and the low-pressure end to be positioned in a parallel manner to attached to the parallel high-pressure and low-pressure lines. In some embodiments, the transition section may have a substantially squared geometry that positions the high-pressure end and the low-pressure end to be positioned in a parallel manner. The transition section may be flexible to allow the high-pressure end and the low-pressure end to be manipulated into position on different line sets that are spaced apart at different distances. In some embodiments, the purging device (e.g., in the transition section) may include a pressure manipulating device that may assist in generating a pressure differential between the high-pressure end and low-pressure end of the coupling device. The pressure manipulating device may reduce the pressure from the high-pressure end to the low-pressure end. For example, a nozzle or Venturi-type device may be positioned inline in the transition section or another part of the purging device that reduces the pressure as the purging fluid moves from the high-pressure end toward the low-pressure end.

For the coupling device to accommodate various low-pressure line diameters, the low-pressure end may have a plurality of diameters sized to secure to typical low-pressure pipe sizes used in HVAC, A/C, and refrigeration systems. The low-pressure end of the purging device may have a plurality of diameters arranging in a plurality of concentric annular receivers integrally formed in the low-pressure end thereof. The largest of the annular receivers may be at the distal end of the low-pressure end and annular receivers of progressively smaller diameters may be formed in the low-pressure end of the purging device, creating a stepwise set of narrowing diameter annular receivers. The annular receivers may have diameter in a range of from about ¼ inch to about 1 and ¼ inch. In some embodiments, the diameters may get progressively smaller from the distal end of the low-pressure end in increments of ⅛ of an inch. The annular receivers of multiple diameters allow for accommodate low-pressure lines in HVAC, A/C, and other cooling systems that have varying diameters. The set of annular receivers in the purging tool of the present device allow a single tool to accommodate low-pressure lines of varying sizes and to be used to connect the high-pressure and low-pressure lines of any such system.

The high-pressure end of the purging device may have an annular receiver with a diameter of ⅜ inch size, which is the standard size for high-pressure lines. The transition section may have the same diameter as the high-pressure end. Both the high-pressure end and the low-pressure end may be secured by crimping the annular receiver to the line or by securing the annular receiver to the line with a hose clamp.

The purging device of the present invention may have a general tubular structure constructed from materials used in HVAC industry standards and the standards of one or more of the American Society of Heating, Refrigerating, and Air-Conditioning Engineers (ASHRAE) and Food and Drug Administration (FDA). In some examples, the device may be constructed from various appropriate materials, such as nitrile rubber, PVC, copper tubing, polyethylene, and combinations thereof, and/or other related materials used in the HVAC and refrigeration industry. In some embodiments, the purging device may be constructed primarily of braided composite nitrile rubber tubing having a uniform inner layer to seal in fluids, and a braided or mesh layer to allow reinforcement with flexibility. The braided composite nitrile rubber tubing may include additional layers, such as an intermediate layer (e.g., a polymer textile layer) to facilitate adherence between the inner uniform layer and the braided layer, and an outer, flexible uniform layer to protect the braided layer or mesh layer. In other embodiments, the purging device may be made from the same kind of braided composite structure made from a one or more other materials for example, PVC, polyethylene (e.g., PEX), polyurethane, nitrile rubber, and other appropriate materials. In some embodiments, the high-pressure end and low-pressure ends may be constructed of similar or the same material, and the transition section may be made from other materials. For example, the transition section may be constructed of a metal layer (e.g., a first copper layer) that is joined to angled connectors made from a composite polymer material (e.g., a braided composite nitrile rubber) with an adhesive, hose clamp, or other connection mechanism.

The purging device may be used in a flushing process for coolant in an HVAC, A/C system, or other refrigeration system. The purging process may be initiated by the creation of access points for introducing the purging gas (and optionally solvent), and collecting the purged material from the line set. This can be done in some contexts at the condenser (if there is a charging block present) and can be done by cutting the line set to create an entry/injection point in the lines and cutting a collection point in the line set at an exit/drain point to allow the purged coolant and debris to be collected for disposal. The severed points in the line set can be reconnected by brazing. A technician must first cut the lines set (e.g., the lines connecting each of the A/C subsystems) at a possible entry/injection point in the high-pressure line and at a possible exit/drain point in the low-pressure line. Once access is created in the high-pressure and low-pressure lines, the coolant may be drained by gravity flow. Once the gravity flow has ceased or slowed, the purging device may be attached to the line set. The high-pressure end of the purging device may be crimped or clamped to the high-pressure line set. The low-pressure end may be coupled to the low-pressure line by placing the severed end of the low-pressure line into annular receiver in the low-pressure end having the corresponding size, and the attached end of the low-pressure line may be crimped or clamped to the second end (e.g., low-pressure end) of the coupling device.

A pressure regulator may be attached to the nitrogen gas tank, and a gauge manifold may be attached to the line set. On the compressor line set, a nitrogen injection nozzle may be pressed against an injection point, and dry nitrogen may be injected into the system, which may be routed through the high-pressure line, through the purging tool allowing the system to purge any remaining coolant into a collection canister connected to the exit/drain point of the line set. During this process, the nominal working pressure of the system should not be exceeded (e.g., 250 psig is a safe pressure for high-pressure refrigerant systems). The flushing process may further include purging the nitrogen through the liquid line toward the compressor and discharging the gas out of the compressor discharge line before the compressor connection location.

The introduction of purging gas may be continued until the coolant is completely removed and deposited in the collection canister and has a clean output from the line. The nitrogen nozzle is then set after the expansion valve, and the nitrogen is purged through the line towards the compressor suction line until the collection canister has a clean output from the line. After this process, there may be debris (e.g., soot, contaminants, mineral build-up, and etc.) in the line set.

To further remove the debris in the line set, a solvent may be injected at the same entry and exit points. In some examples, the exit point may be crimped to increase the pressure in the line and subsequently to increase the mass flow rate of the solvent as it travels through the line. The collection canister may be placed at the exit, and the fluid is monitored and caught to determine the cleanliness of the solvent.

Once the solvent is no longer collecting any debris or contaminants from the line set, the purging process is complete for the purged section of the line set and the line set can be reattached to the system by brazing or other acceptable method. The purging process is continued in successive line sets until the entire line set running from the condenser to the evaporator is purged.

Several exemplary embodiments are described herein, and are illustrative, but do not limit the scope of the invention. Some exemplary embodiments are described immediately below.

In one aspect, the present invention relates to a device for closing the loop of a condenser line-set, the device comprising a tube comprising a flexible material that allows the tube to manipulated into elliptical bends, the tube having a high-pressure end operable to connect to a high-pressure line of the condenser line set; and a low-pressure end operable to connect to a low-pressure line of the condenser line set, wherein the first end has a plurality of concentric annular receivers of different diameters for coupling to the low-pressure line. The tube may include a polymeric mesh material that allows for flexing and bending of the tube without breaches or kinks in the tube. The tube may include a transition section between the high-pressure end and the low-pressure end, the transition section having a tapering inner diameter between the high-pressure end and the low-pressure end that is operable to create a pressure differential between the low-pressure line and high-pressure line of the condenser. The high-pressure end may have a fixed diameter ranging from ¼ inch to 1⅛ inch for securing around the high-pressure line set. The high-pressure end may have a length ranging from 4.5 inches up to 12 inches. The low-pressure end may have a length ranging from 6.5 inches up to 15 inches. The total length of the tube may be in a range of from about 18 inches to about 36 inches. The plurality of annular receivers may include annular receivers having diameters of about ¼ inch, about ⅜ inch, about ½ inch, about ⅝ inch, ¾, and about ⅞ inch. The plurality of annular receivers may each have an axial length of at least about one inch. The tube may further include hose clamps operable to secure the first end and the second end to the low-pressure line and outlet.

In a second aspect, the invention relates to a method for flushing excess refrigerant from a line set of a condenser comprising the steps of creating access points in a low-pressure line and a high-pressure line of the line set; connecting a high-pressure end of a purging device to the access point in the high-pressure line; connecting a low-pressure end of the purging device to the access point in the low-pressure line, wherein the first end has a plurality of concentric annular receivers of different diameters for coupling to the low-pressure line; securing the high-pressure end and low-pressure end to the line set using a coupling mechanism; and connecting a flush canister comprising a fluid to a service valve on the condenser and passing the fluid through the line set to remove coolant fluid from the line set. The condenser line set may be cut to have a length that allows the fluid to be passed through the line set at a pressure that does not exceed the operating pressure of the condenser. The purging device may include a polymeric mesh material that allows for flexing and bending of the tube without breaches or kinks in the tube. The purging device may comprise a transition section between the high-pressure end and the low-pressure end, the transition section having a tapering inner diameter between the high-pressure end and the low-pressure end that is operable to create a pressure differential between the low-pressure line and high-pressure line of the condenser. The high-pressure end may have a fixed diameter ranging from ¼ inch to 1⅛ inch for securing around the high-pressure line set. The high-pressure end may have a length ranging from 4.5 inches up to 12 inches. The low-pressure end may have a length ranging from 6.5 inches up to 15 inches. The total length of the purging device may be in a range of from about 18 inches to about 36 inches. The plurality of annular receivers may include annular receivers having diameters of about ¼ inch, about ⅜ inch, about ½ inch, about ⅝ inch, ¾, and about ⅞ inch. The plurality of annular receivers may each have an axial length of at least about one inch. The coupling mechanism may be a hose clamp.

In one aspect, the present invention relates to a device for closing the loop of a condenser line-set, the device comprising a tube comprising a flexible material that allows the tube to manipulated into elliptical bends, the tube having a high-pressure end operable to connect to a high-pressure line of the condenser line set, and a low-pressure end operable to connect to a low-pressure line of the condenser line set, wherein the first end has a plurality of concentric annular receivers of different diameters for coupling to the low-pressure line; and a transition section between the high-pressure end and the low-pressure end, the transition section having a tapering inner diameter between the high-pressure end and the low-pressure end that is operable to create a pressure differential between the low-pressure line and high-pressure line of the condenser. The tube may include a polymeric mesh material that allows for flexing and bending of the tube without breaches or kinks in the tube. The high-pressure end may have a fixed diameter ranging from ¼ inch to 1⅛ inch for securing around the high-pressure line set. The high-pressure end may have a length ranging from 4.5 inches up to 12 inches. The low-pressure end may have a length ranging from 6.5 inches up to 15 inches. The total length of the tube may be in a range of from about 18 inches to about 36 inches. The plurality of annular receivers may include annular receivers having diameters of about ¼ inch, about ⅜ inch, about ½ inch, about ⅝ inch, ¾, and about ⅞ inch. The plurality of annular receivers may each have an axial length of at least about one inch. The tube may further include hose clamps operable to secure the first end and the second end to the low-pressure line and outlet.

It is an object of the present invention to provide a method for flushing excess refrigerant from an HVAC condenser line set after a preliminary drain and nitrogen purge comprising the steps of: disconnecting the condenser from an evaporator by cutting the low-pressure and high-pressure lines, connecting the second end of the coupling device to the high-pressure line and the first end to the low-pressure line, securing the lines to the line set, and connecting a flush canister to a service valve on the condenser and opening the valve to circulate a flush through the condenser loop.

It is an object of this invention to provide a tool that allows for purging of coolant lines in an HVAC condenser line set that requires only a single technician.

It is an object of the present invention to provide a device for closing the loop of a condenser line set comprising: a U-shaped tube having a base connecter, two ends, and hose clamps, a first end connecting to the low-pressure line of the condenser line set, and a second end connecting to the high-pressure line.

It is a further object of the present invention to provide a first end with a plurality of coupling points (annular receivers) of different diameters that are concentric to preceding diameters securing the condenser low-pressure line.

It is a further object of the present invention to provide a base connector having a oval cross-sectional geometry operable to generate a pressure differential between the low-pressure and high-pressure line.

It is a further object of the present invention to provide a second end having a fixed diameter ranging from ¼ inch to 1⅛ inch for securing around the low-pressure line of the line set.

It is a further object of the present invention to provide a first end length ranging from 4.5 inches up to 12 inches for securing the low-pressure line.

It is a further object of the present invention to provide hose clamps operable to secure the first and second ends of the coupling device to the high-pressure and low-pressure lines of the condenser.

The above-described objects, advantages, and features of the invention, together with the organization and manner of operation thereof, will become apparent from the following detailed description when taken in conjunction with the accompanying drawings, wherein like elements have like numerals throughout the several drawings described herein. Further benefits and other advantages of the present invention will become readily apparent from the detailed description of the preferred embodiments.

BRIEF DESCRIPTION OF THE DRAWINGS

FIG. 1 provides a perspective view of the coupling tube device, according to an embodiment of the present invention.

FIG. 2A provides a side view of the coupling tube device, according to an embodiment of the present invention.

FIG. 2B provides a side view of the coupling tube device according to an embodiment of the present invention.

FIG. 2C provides a side view of the coupling tube device according to an embodiment of the present invention.

DETAILED DESCRIPTION

Figure 3A:
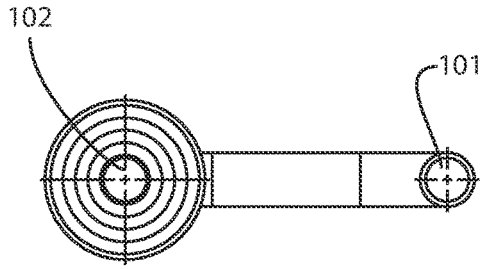
FIG. 3A provides a top view of the coupling tube device according to an embodiment of the present invention.

Reference will now be made in detail to certain embodiments of the invention, examples of which are illustrated in the accompanying drawings. While the invention will be described in reference to these embodiments, it will be understood that they are not intended to limit the invention. To the contrary, the invention is intended to cover alternatives, modifications, and equivalents that are included within the spirit and scope of the invention. In the following disclosure, specific details are given to provide a thorough understanding of the invention. However, it will be apparent to one skilled in the art that the present invention may be practiced without all of the specific details provided.

The present invention concerns a connecting device to close the loop of a condenser line set when flushing and performing maintenance of a heating ventilation and air conditioning (HVAC) system. FIGS. 1-6 provides views of an exemplary line set connecting device 100 and methods of use according to the present invention. The exemplary line set connecting device 100 is a device to join the low-pressure line and the high-pressure line of a condenser used in HVAC systems. The line set connector 100 may have a substantially U-shaped geometry comprising a first end 101 (high-pressure end), a second end 102 (low-pressure end), and a base connector 103 (transition section).

As shown in the exemplary embodiment of FIG. 1, the second end 102 of the device 100 may include various diameters D6, D5, D4, D3, D2, and D1. The diameter is reducing in size from the largest diameter D6 to the smallest diameter D1. The diameters D6-D1 may be constructed to accommodate liquid line set standards for use in refrigeration and HVAC systems. The joining member 103 may connect the first end 101 to a second end 102. The second end 102 may have a fixed inner diameter of ⅜ inch. The diameter D1-D6 may range, e.g., from ¼ inch to 1 and ¼ inch. For example, D1 may have a diameter of ¼, D2 may have a ⅜, D3 may have a ½, D4 may have a ⅝, D5 may have a ¾, and D6 may have a ⅞. The length of the joining member may be in a range of about 3 inches to about 8 inches.

FIG. 2A and FIG. 2B shows side views of the device of FIG. 1. The first end 101 has a central axis having an angle 105 of about 90° with respect to the central axis of the joining member 103. The second end 102 has a central axis having an angle 106 of about 90° with respect to the central axis of the joining member 103. The curved portions between the joining member 103 and the first end 101 may be flexible to allow adjustment of the tool for use between line sets that have varying spacing between the high-pressure line and the low-pressure line. In some embodiments, the entire connector 100 may be comprised of a flexible, but sturdy material, such as a composited braided nitrile rubber material, as discussed herein. FIG. 2C shows an embodiment of the device 100, where the first end 101 and second end 102 and the joining member 103 are incorporated into a single continuous tube without formed angles or turns therein. In such examples, the flexibility of the tube material is sufficient to allow the device 100 to be bent back on itself to create turns of up to about 180° to facilitate the joining of the first end 101 and the second end 102 with an HVAC line set.

Figure 3B:
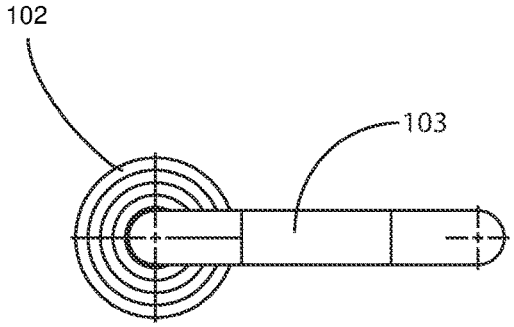
FIG. 3B provides a bottom view of the coupling tube device according to an embodiment of the present invention.

FIG. 3A and FIG. 3B showing the top and bottom views of the device of FIG. 1, the first end 101, has the various diameters D1-D6 may be concentrically staggered between each previous diameter the diameter D1 may have the same diameter of the joining member 103. The second end 102 may have a central axis that is about parallel to and substantially on the same plane as the first end 101, and about perpendicular to the central axis of the joining member 103.

Figure 4A:
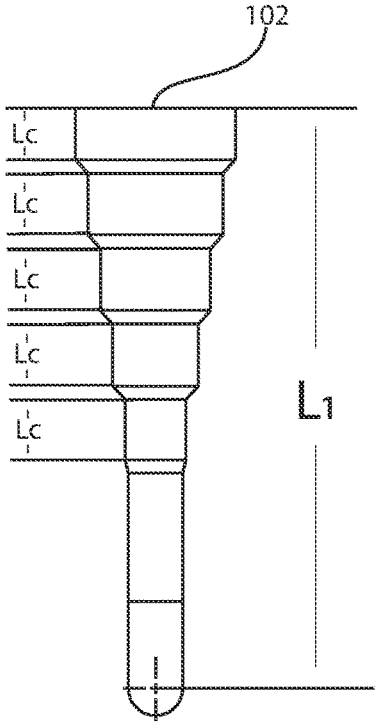
FIG. 4A provides a rearview of the coupling tube device according to an embodiment of the present invention.
Figure 4B:
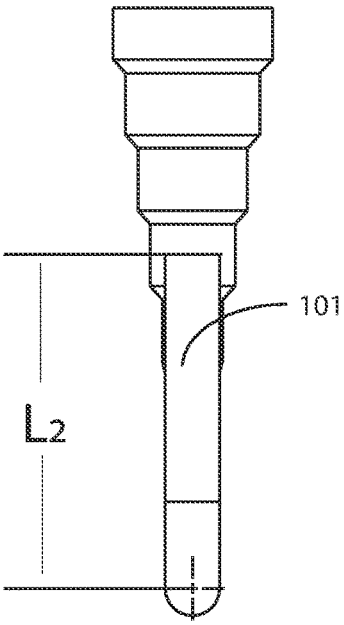
FIG. 4B provides a front view of the coupling tube device according to an embodiment of the present invention.
Figure 4C:
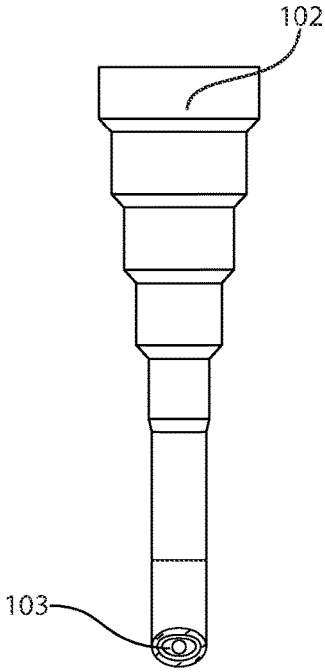
FIG. 4C provides a cross-sectional view of the coupling tube device according to an embodiment of the present invention.

As shown in FIG. 4A, FIG. 4B and FIG. 4C the first end 101 and the various diameters D1-D6 may have a length Lc of at least one inch (e.g., in a range of 1 in. to about 3 inches) to allow for a suitable compression around the line the Lc may be secured with a hose clamp around the circumference of the diameter. The overall length L2 of the first end 101 may be substantially longer than the length L1 of the second end 102. The second end 102 may have a length L1 operable to nest around the low-pressure line 116. In some embodiments, the joining member 103 may have an elliptic geometry and/or sufficient flexibility to accommodate the necessary manipulation second end 102 to properly nest around the particular diameter of a low-pressure line. The joining member 103 may also have a design that aids in generating a pressure differential between the first end and second end 101, 102. In some embodiments, the elliptical shape of the joining member when the device 100 is attached to the line sets creates sufficient friction with the fluid flowing therethrough to allow a reduction in pressure from the high-pressure line to the low-pressure line. In other examples a nozzle or Venturi device may be embedded in the joining member to adjust the pressure of the fluid as it passes from the high-pressure first end 101 to the low-pressure second end 102.

Figure 5:
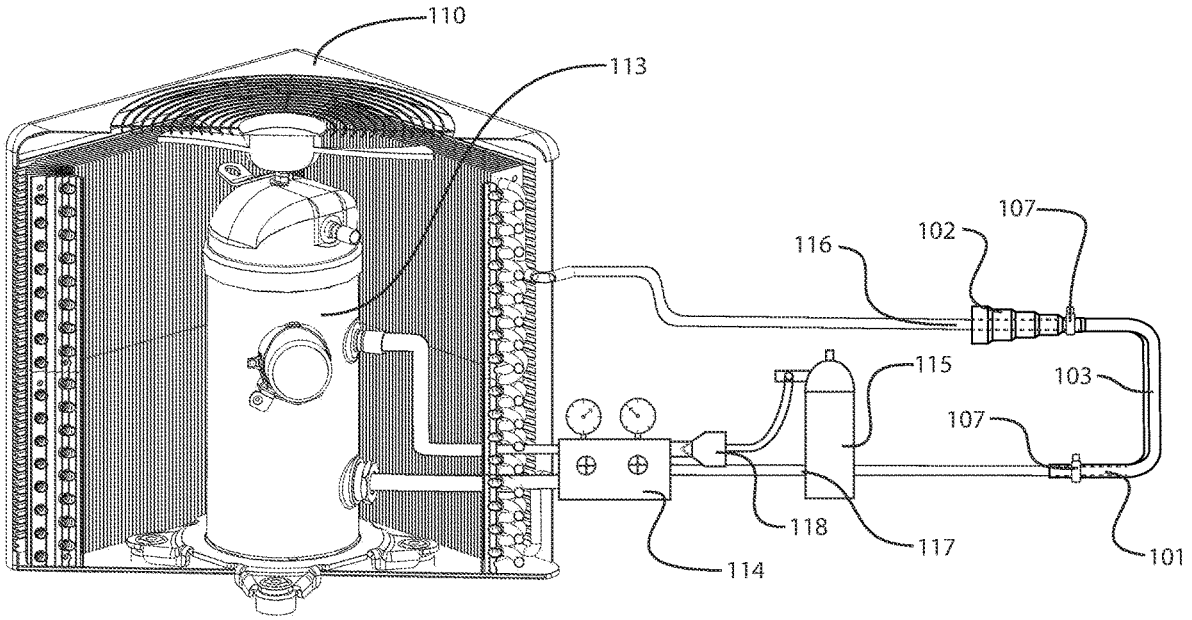
FIG. 5 provides an exemplary view of the coupling tube device used in a condenser and compressor system.

FIG. 5 shows an exemplary method of the use of the coupling tube device 100 configured between the high-pressure line 117 and low-pressure line 116. The line set may be connected to a compressor 113 of the condenser 110, and may be monitored by a service block and valves 114 that displays information regarding the pressure of the fluid in the line set. The line set may have service access points near the condenser that allow the coolant present in the line set to be drained from the system. Pressurized flushing fluid may also be introduced at the service access points. The coolant may be drained from the system prior to a pressurized flush of the system.

Access points for connection of the coupling tube 100 may be cut into the line set in order to facilitate a pressurized flush of the system. The each of the lines may be cut at approximately the same point along the lines. The coupling tube 100 device may be attached on the first end 101 to the high-pressure line 117. The appropriate diameter annular receiver (any of D1-D6) of the second end 102 that matches the diameter of the low-pressure line 116 may be placed around the low-pressure line 116. Each of the first and second ends 101, 102 may be secured in place by a hose clamp 107, but preferably may be secured in place by crimping the lines at the location 107. Nitrogen gas may be used as a pressurized fluid to push any excess coolant out of the line set that did not gravity drain out of the line set.

Subsequently, a flushing fluid (e.g., a solvent) may then be introduced into the line set. A canister 115 may provide the supply of flushing fluid and may have a nozzle 118 that is connected to the service block and valves 114, which may discharge the flushing fluid into the HVAC, A/C or other refrigeration system for dissolving and neutralizing unwanted material in the system when servicing. The fluid may travel throughout the closed-loop and through the purging device 100. The purging device 100 may be attached to the line set 116, 117, at a location not exceeding 50 ft away from the service block and valves 114, in order to avoid applying pressures that exceed the nominal working pressure of the system. Greater distances may require that the nominal working pressure of the system be exceeded in order to properly drive the flushing fluid through the system.

Figure 6:
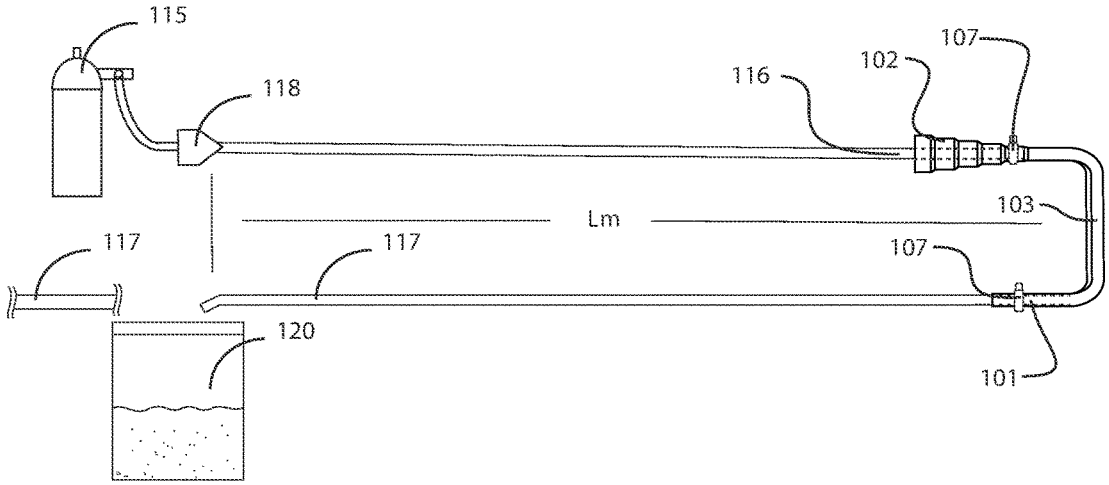
FIG. 6 provides an exemplary view of the coupling tube device used in a line set

FIG. 6 provides an exemplary view of the device of FIG. 1 used for flushing a line set with lines exceeding 50 ft. The high-pressure 117 and low-pressure 116 lines may be cut at intervals of 50 ft, and the flushing processes may be conducted. A collecting bucket 120 may retrieve the flush at the outlet of the high-pressure line 117, and the coupling tube device 100 may be attached on the first end 101 to the high-pressure line 117, and the second end 102 may be placed around the low-pressure line 116. The first and second ends 101, 102 may be secured in place by a hose clamp 107 or crimping of the lines at the locations 107. The nozzle 118 of the flushing canister 115 may be nested into the low-pressure line 116, and the flush may travel through the loop, and the excess debris is disposed of from the high-pressure line 117 into the collection bucket 120.

CONCLUSION/SUMMARY

The present invention provides an improved method for flushing a solvent through a line set of a condenser, and a compressor, and routing of heat ventilation and air-conditioning, and a high-pressure to low-pressure coupling device. The novel device being operable for joining the high-pressure and low-pressure lines and eliminate the need for having multiple technicians present for conducting a line set flush. It is to be understood that variations, modifications, and permutations of embodiments of the present invention, and uses thereof, may be made without departing from the scope of the invention. It is also to be understood that the present invention is not limited by the specific embodiments, descriptions, or illustrations, or combinations of either components or steps disclosed herein. The embodiments were chosen and described in order to best explain the principles of the invention and its practical application, to thereby enable others skilled in the art to best utilize the invention and various embodiments with various modifications as are suited to the particular use contemplated. Although reference has been made to the accompanying figures, it is to be appreciated that these figures are exemplary and are not meant to limit the scope of the invention. It is intended that the scope of the invention be defined by the claims appended hereto and their equivalents.

What is claimed is:

1. A method for flushing excess refrigerant from a line set of a condenser comprising the steps of:

a. creating access points in a low-pressure line and a high-pressure line of said line set;

b. connecting a high-pressure end of a purging device to said access point in said high-pressure line;

c. connecting a low-pressure end of said purging device to said access point in said low-pressure line, wherein said low-pressure end has a plurality of concentric annular receivers of different diameters for coupling to said low-pressure line;

d. securing said high-pressure end and low-pressure end to said line set using a fastener; and e. connecting a flush canister comprising a fluid to a service valve on the condenser and passing said fluid through said line set to remove coolant fluid from said line set.

2. The method of claim 1, wherein said condenser line set is cut having a length that allows the fluid to be passed through the line set at a pressure that does not exceed the operating pressure of the condenser.

3. The method of claim 1, wherein said purging device comprises a transition section between said high-pressure end and said low-pressure end, said transition section having a tapering inner diameter between said high-pressure end and said low-pressure end that is operable to create a pressure differential between said low-pressure line and high-pressure line of said condenser.

4. The method of claim 1, wherein said high-pressure end has a fixed diameter ranging from ¼ inch to 1⅛ inch for securing around said high-pressure line set.

5. The method of claim 1, wherein said plurality of annular receivers includes annular receivers having diameters of about ¼ inch, about ⅜ inch, about ½ inch, about ⅝ inch, ¾ inch, and about ⅞ inch.

6. The method of claim 1, wherein said plurality of annular receivers each have an axial length of at least about one inch.

7. A method for flushing excess refrigerant from a line set of a condenser comprising the steps of:

a. connecting a high-pressure end of a purging device to an access point in a high-pressure line;

b. connecting a low-pressure end of said purging device to an access point in said low-pressure line, wherein said low-pressure end has a plurality of concentric annular receivers of different diameters for coupling to said low-pressure line; and c. passing a fluid through said line set to remove coolant fluid from said line set.

8. The method of claim 7, further comprising creating access points in a low-pressure line and a high-pressure line of said line set, wherein said condenser line set is cut having a length that allows the fluid to be passed through the line set at a pressure that does not exceed the operating pressure of the condenser.

9. The method of claim 7, further comprising connecting a flush canister comprising a fluid to a service valve on the condenser.

10. The method of claim 7, wherein said purging device comprises a transition section between said high-pressure end and said low-pressure end, said transition section having a tapering inner diameter between said high-pressure end and said low-pressure end that is operable to create a pressure differential between said low-pressure line and high-pressure line of said condenser.

11. The method of claim 7, wherein said high-pressure end has a fixed diameter ranging from ¼ inch to 1⅛ inch for securing around said high-pressure line set.

12. The method of claim 7, wherein said plurality of annular receivers includes annular receivers having diameters of about ¼ inch, about ⅜ inch, about ½ inch, about ⅝ inch, ¾ inch, and about ⅞ inch.

13. The method of claim 7, wherein said plurality of annular receivers each have an axial length of at least about one inch.

14. A method for flushing excess refrigerant from a line set of a condenser comprising the steps of:

a. creating access points in a low-pressure line and a high-pressure line of said line set;

b. connecting a high-pressure end of a purging device to said access point in said high-pressure line;

c. connecting a low-pressure end of said purging device to said access point in said low-pressure line, wherein said low-pressure end has a plurality of concentric annular receivers of different diameters for coupling to said low-pressure line; and d. passing a fluid through said line set to remove coolant fluid from said line set.

15. The method of claim 14, wherein said condenser line set is cut having a length that allows the fluid to be passed through the line set at a pressure that does not exceed the operating pressure of the condenser.

16. The method of claim 14, further comprising connecting a flush canister comprising a fluid to a service valve on the condenser for passing said fluid through said line set to remove coolant fluid from said line set.

17. The method of claim 14, wherein said purging device comprises a transition section between said high-pressure end and said low-pressure end, said transition section having a tapering inner diameter between said high-pressure end and said low-pressure end that is operable to create a pressure differential between said low-pressure line and high-pressure line of said condenser.

18. The method of claim 14, wherein said high-pressure end has a fixed diameter ranging from ¼ inch to 1⅛ inch for securing around said high-pressure line set.

19. The method of claim 14, wherein said plurality of annular receivers includes annular receivers having diameters of about ¼ inch, about ⅜ inch, about ½ inch, about ⅝ inch, ¾ inch, and about ⅞ inch.

20. The method of claim 14, wherein said plurality of annular receivers each have an axial length of at least about one inch.

* * * * *